US007018129B1

(12) United States Patent
Smith

(10) Patent No.: US 7,018,129 B1
(45) Date of Patent: Mar. 28, 2006

(54) ENHANCED GUARDRAIL

(75) Inventor: Harry E. Smith, Irwin, PA (US)

(73) Assignee: Herwin Inc., Rillton, PA (US)

( * ) Notice: Subject to any disclaimer, the term of this patent is extended or adjusted under 35 U.S.C. 154(b) by 0 days.

(21) Appl. No.: 10/654,824

(22) Filed: Sep. 4, 2003

Related U.S. Application Data

(60) Provisional application No. 60/408,713, filed on Sep. 6, 2002.

(51) Int. Cl.
*G09F 15/00* (2006.01)

(52) U.S. Cl. ..... 404/6; 404/9; 40/447; 40/606.01; 40/606.14; 256/1

(58) Field of Classification Search ..... 404/6, 404/9; 116/63 R; 256/1, 13.1; 40/447, 40/463, 606.01, 606.14
See application file for complete search history.

(56) References Cited

U.S. PATENT DOCUMENTS 3,468,567 A * 9/1969 Henry et al. ..... 403/395
3,553,870 A * 1/1971 Rudolph ..... 40/576
3,598,923 A * 8/1971 Turner ..... 343/788
3,617,076 A * 11/1971 Attwood et al. ..... 403/395
4,000,882 A * 1/1977 Penton ..... 256/13.1
4,221,498 A * 9/1980 Schueler et al. ..... 404/9
4,723,758 A * 2/1988 Gehrig ..... 256/13.1
5,202,742 A * 4/1993 Frank et al. ..... 356/5.1
5,241,467 A * 8/1993 Failing et al. ..... 705/1
5,553,412 A * 9/1996 Briechle et al. ..... 40/124.01
5,775,016 A * 7/1998 Chien ..... 40/544
5,950,992 A * 9/1999 Weid ..... 256/13.1
6,069,596 A * 5/2000 Marvin et al. ..... 345/52
6,107,941 A * 8/2000 Jones ..... 340/915
6,328,284 B1 * 12/2001 Wilding ..... 256/13.1
6,556,147 B1 * 4/2003 Fisher et al. ..... 340/908
6,844,821 B1 * 1/2005 Swartzel et al. ..... 340/691.6

FOREIGN PATENT DOCUMENTS

| | | | |
|---|---|---|---|
| EP | 0 390 749 | * | 1/1990 |
| JP | 7-26526 | * | 1/1995 |
| JP | 2001-34214 | * | 2/2001 |
| JP | 2002-266324 | * | 9/2002 |

* cited by examiner

*Primary Examiner*—Gary S. Hartmann

(57) ABSTRACT

A guardrail comprising a rail and an electronic display mounted on the rail. The display may be integrated with a bar code or RFID reader and a voice-recognition module.

10 Claims, 12 Drawing Sheets

ENHANCED GUARDRAIL

CROSS-REFERENCE TO RELATED APPLICATION

The benefit of provisional application No. 60/408,713 filed Sep. 6, 2002 is claimed. Provisional application No. 60/408,713 filed Sep. 6, 2002 is incorporated here by reference.

BACKGROUND OF THE INVENTION

1. Technical Field

This invention relates to improvements in guardrails.

2. Background

Guardrails are generally located next to defined pathways of motorized or pedestrian traffic. They are commonly installed in industrial and warehouse locations to protect employee work areas, product and material storage areas, and equipment from forklift and mobile equipment traffic. Guardrails are also installed along roadways for parking and traffic control, for instance at retail store and mall parking lots.

Guardrail products and their manufacturers include: Instant-Rail protective guardrail of Cogan Wire & Metal Products, Montreal, QC; Steel Guard barriers of Steel King Industries, Stevens Point, Wis.; Saf-T-Rail protective railing system of Torbeck Industries, Harrison, Ohio; Barrier Rail of W. A. Schmidt, Horsham, Pa.; and Wilgard protective railing systems of Wildeck Mezzanines, Waukesha, Wis.

DISCLOSURE OF INVENTION

1. Introduction

The invention provides an improvement to guardrail installations by integrating an electronic display with the rail of the guardrail.

2. Objects of the Invention

The invention enables quick and easy communication of information to personnel in a factory or warehouse setting using an electronic display installed in a specially configured guardrail as the communication tool. Information can include safety messages, corporate policies, individual employee instructions, or other alphanumeric information, including logos and symbols. Other settings where the invention can be used include parking lots and along roadways.

3. Electro-Mechanical Arrangements

The display is preferably inset into, i.e. recessed in, a specially configured guardrail and fastened in place. The recessing protects the display from damage if a forklift or other mobile equipment hits the guardrail. The recessing is achieved, for example, by forming structural ribs on the guardrail section that protrude beyond the face of the display. Electrical power and communication wires are connected to the display, for instance through the backside of the guardrail.

The angle of the display may or may not be 90 degrees perpendicular with floor. For instance, in preferred embodiments of the invention, the display is inclined from 0 to 30 degrees, however to achieve optimum performance it should be inclined 2 to 22 degrees. This tilting of the display significantly increases the visibility of the display for mobile and pedestrian traffic moving near the guardrail. Even at the highest angle of rotation of the display, the display is protected by the ribs of the guardrail.

Guardrail, which may be of various lengths, is usually supported with vertical columns, or posts, on each end. The posts are securely fastened to the floor. Usually guardrail is painted safety yellow. The specially configured guardrail with display can be integrated into existing guardrail installations.

Thus, universal guardrail end mounting brackets and adaptors are provided for the guardrail with display. In preferred embodiments of the invention, these end mounting brackets and adaptors are compatible with the guardrails of leading manufacturers of guardrail in North America. This will allow users of the invention to retrofit existing guardrail installations. By replacing one of the existing rails with a guardrail of the invention and installing the electrical and communication wiring, one can upgrade a standard guardrail installation into a unique message communication center.

In an example of the invention, an 8' LED display with 4" high, red letters is integrated into the specially configured guardrail at an angle ranging from 2° to 22°. The angle is chosen so traffic traveling close to the unit can see the message. This display can be read as close as 2 feet and as far away as 200 feet.

4. Message Control

Preferably, the information on the display changes on command from computer, e.g. standalone (directly wired to the display, including a captive computer or an embedded micro-controller), networked, or phone modem or wireless connected, using a variety of software formats, such as TCP/IP, RS232 and RS422. Thus, messages may be transmitted to the display via wire or wireless computer commands. On a computer network, each unit of guardrail with display will have its own electronic address and, therefore, it is easy for each unit to display a different message. The display may be adapted to operate on a variety of voltages.

Messages can be changed simply by typing a new message into a computer running specially designed software, or messages can be activated under software control based on information transmitted to the computer from sensors, for instance barcode readers, Radio Frequency Identification (RFID) tag (chip) readers, or voice-recognition modules.

Thus, in optional embodiments, a barcode reader or RFID tag reader may be added to provide the ability to scan barcode labels or RFID tags attached to product, dollies, fork trucks, pallets, totes, etc. Their data is transmitted to software running on a computer. Alternatively, the data is saved in the unit's memory until polled by software for the data.

The RFID, Barcode, and voice recognition detectors and sensors may be located within the display unit or in another storage area on the guardrail or within its proximity.

An optional microphone in a voice-recognition module provides the ability for voice input. Voice-recognition software reacts to the voice input of specified key phrases. The key phrases are reacted to locally by displaying a configured message and/or sounding an alarm. Alternatively, the key phrases are sent for processing by software in a remote computer.

Message software may be installed in a personal data assistant (PDA) such as a Palm Pilot and message commands sent to the display from the PDA located anywhere using the Internet.

A variety of display formats can be made available through software. The computer operator can select the message to scroll, lock in place, or move in a variety of attention getting ways.

The ability to change messages facilitates giving quick, concise visual instructions to personnel in a manufacturing or warehouse environment. If a number of the display guardrails of the invention are used in the same facility and they are operated on the same computer network, each can display the same or a different message at the same time.

The display can show visual messages of general content such as: Employee meeting 1:00 pm; Update W-4 forms by Feb. 28, 2003; Company stock, up 1.50 today; and Time/Date. And, general safety messages such as: Safety First; Keep Alert; Slow Pedestrians; Safety Glasses Required; and Hard Hat Area. Emergency Messages: Evacuate area 1; Fire; This way out; and Paramedics this way. Specific Information: Driver 5, dock 7; Dock 7 vacant; and Dave Smith report to office. Note that in these examples, the messages are the written equivalents of a word or words of a spoken language, in this case English.

In preferred embodiments of the invention, messages, including the examples of the previous paragraph, are stored in a database and the software enforces access levels, such that, authorization to issue selected messages to specific displays is divided among clerical employees, guards, supervisors, management, etc.

5. Advantages

Guardrails of the invention provide an effective way of communicating to floor personnel in a factory or warehouse environment, with customers in the parking lot of a retail store, or with vehicle operators along roadways.

The guardrail and integrated display may be marketed with other guardrail accessories.

The enhanced guardrail can be made available to users or manufacturers of other guardrail products and integrated into their existing or future guardrail installations.

MODES OF THE INVENTION

Figure 1:
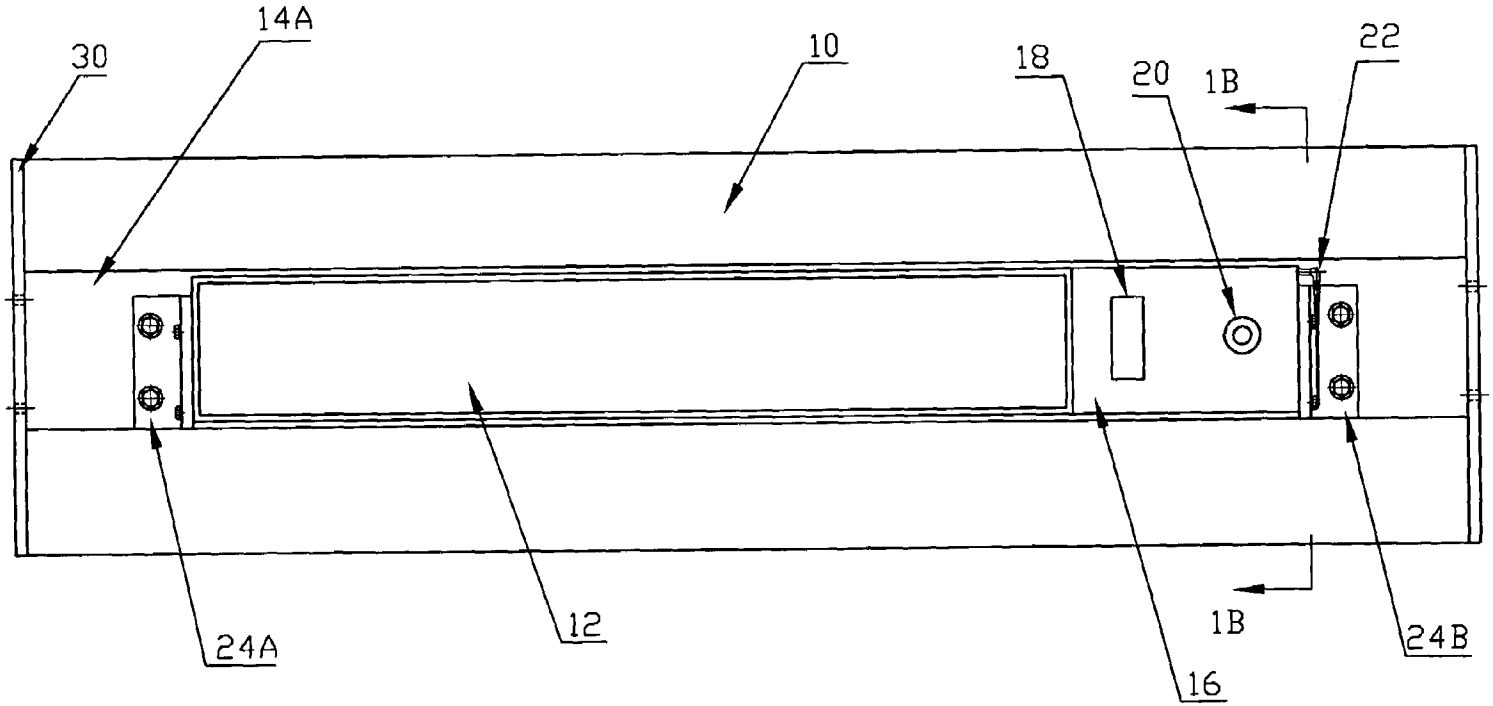
FIG. 1 is a front view of a guardrail of the invention.
Figure 1A:
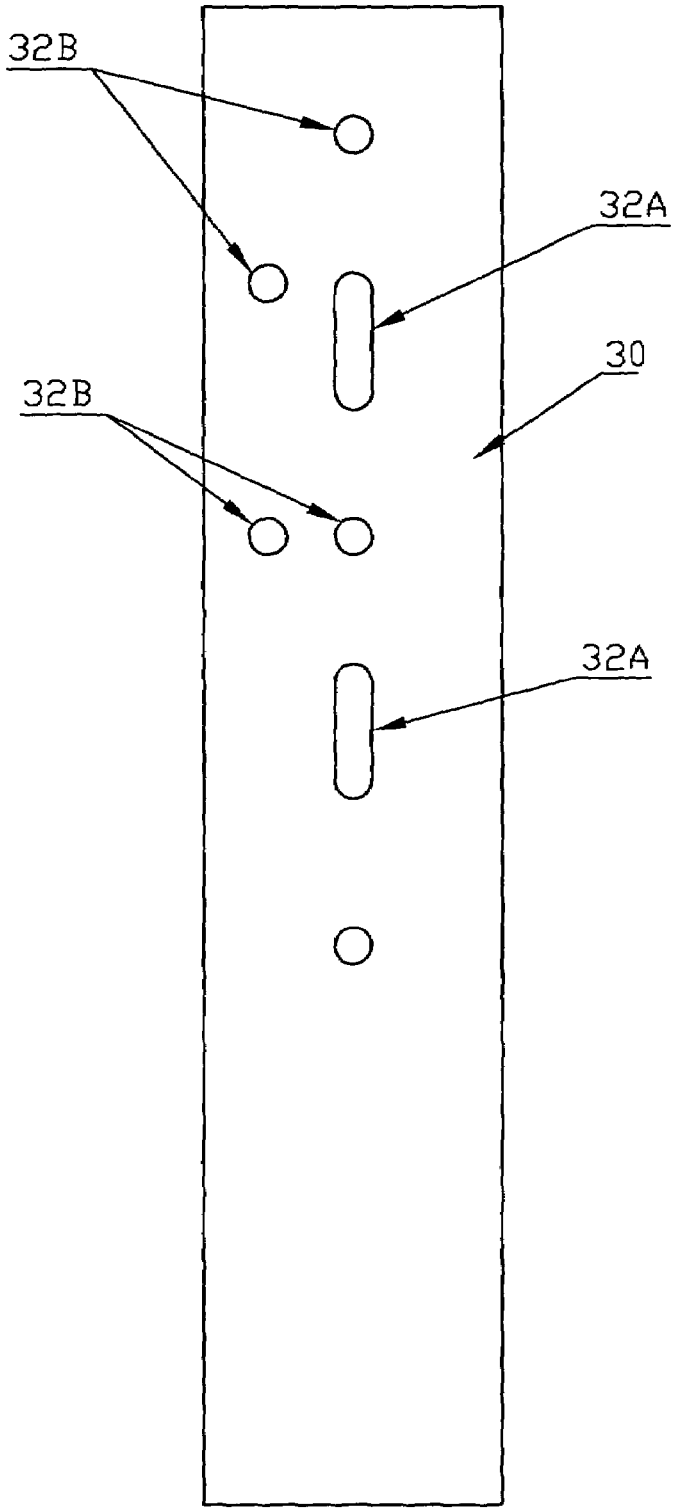
FIG. 1A is a view of the right end of the guardrail of FIG. 1.
Figure 2:
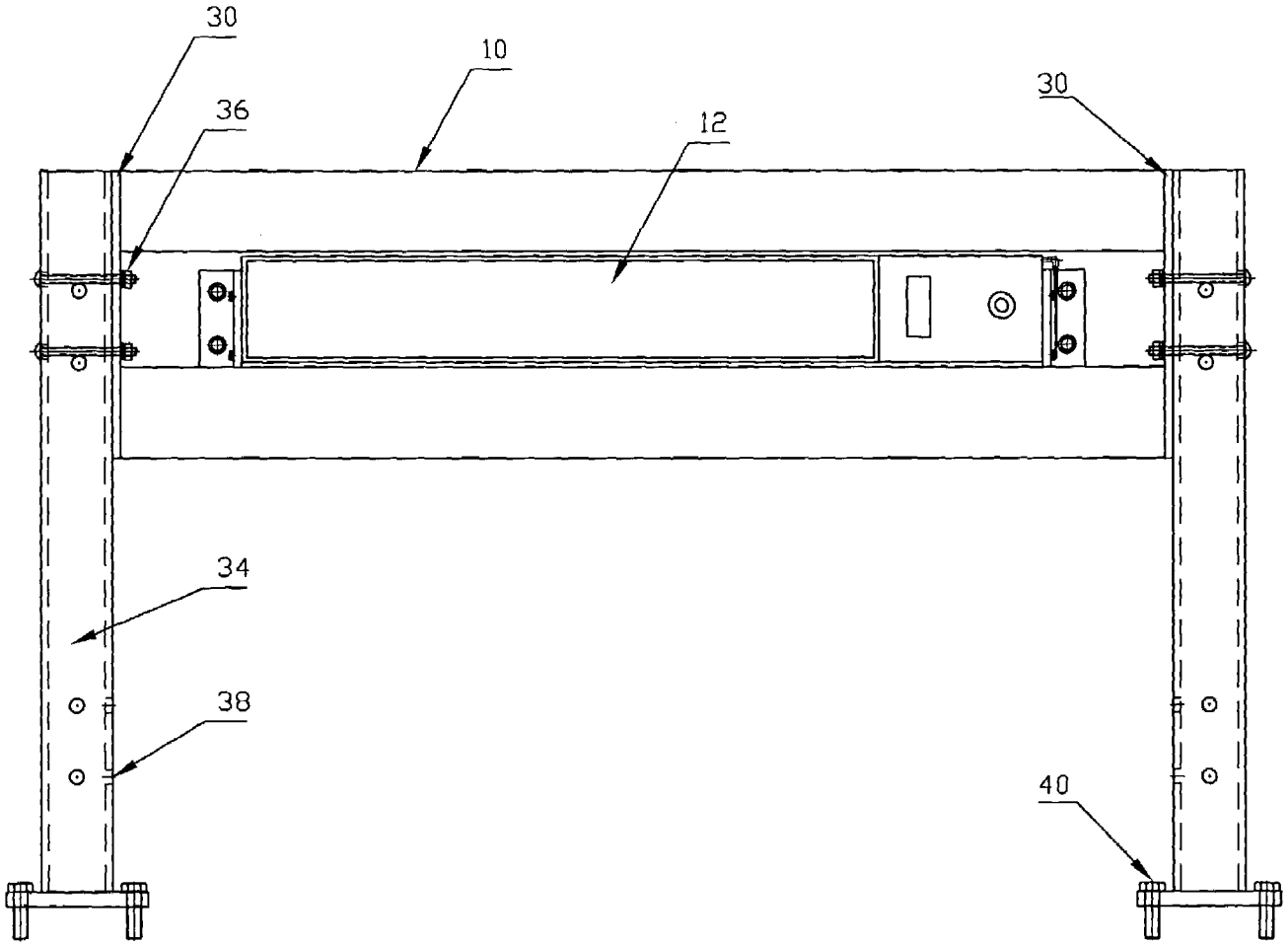
FIG. 2 is a view as in FIG. 1 of the guardrail mounted on posts.
Figure 3:
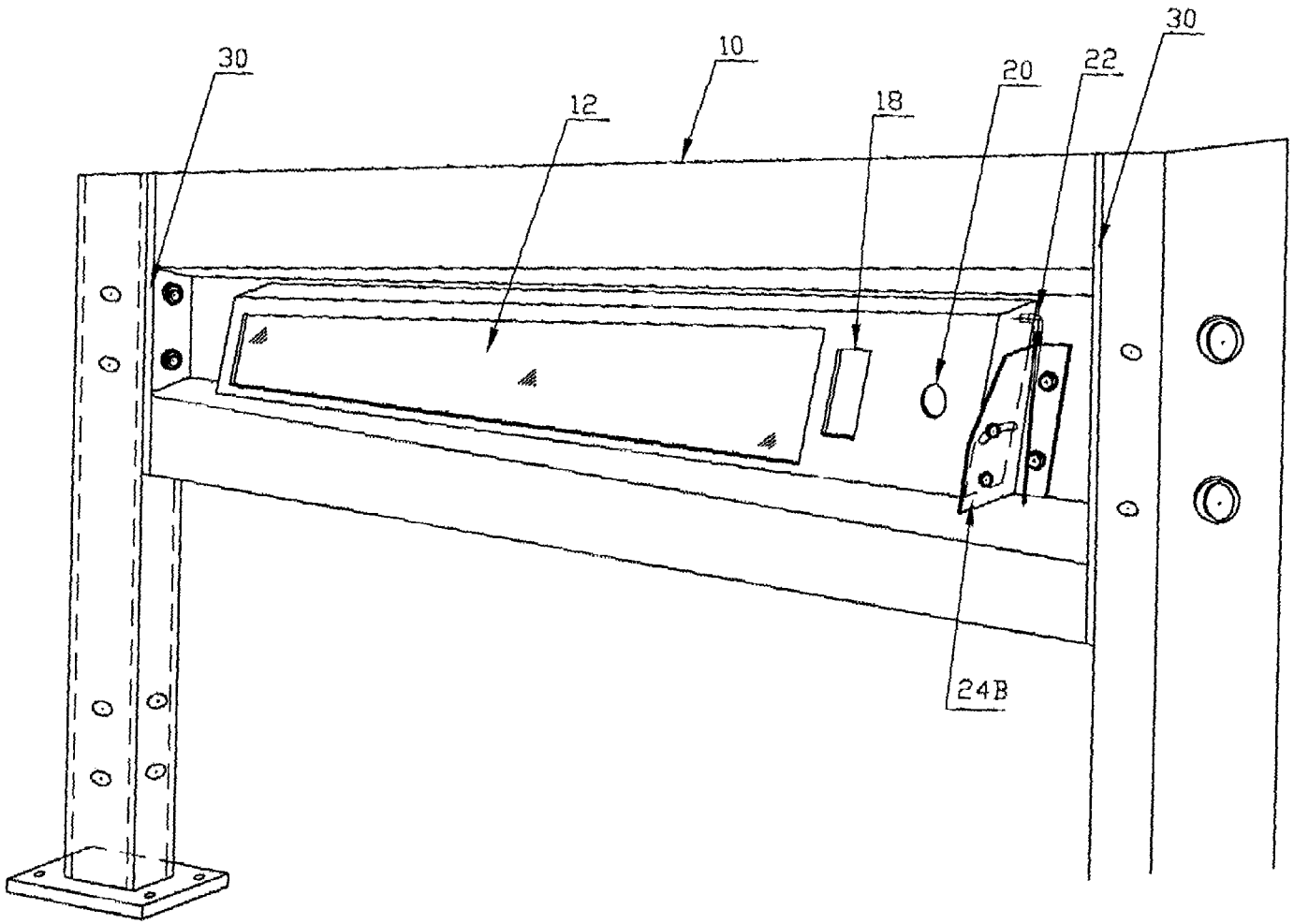
FIG. 3 is a perspective view from the right front side of FIG. 2.

Referring first to FIGS. 1 to 3, this embodiment of a guardrail of the invention includes a specially configured rail 10 and an electronic display 12 mounted in a recess 14A of the rail. Rail 10 is provided in the form of a wrought steel profile.

As shown particularly in FIG. 1B, rail 10 considered from the front is formed with two elongated convex sections 10A,B arranged, respectively, above and below a concave section 10C. These curved sections lend rigidity to rail 10. Section 10C forms recess 14A open to the front of the rail, while sections 10A,B provide recesses 14B,C open to the back of the rail. Considered from the front of the rail, sections 10A,B form structural, protective ribs.

Figure 1B:
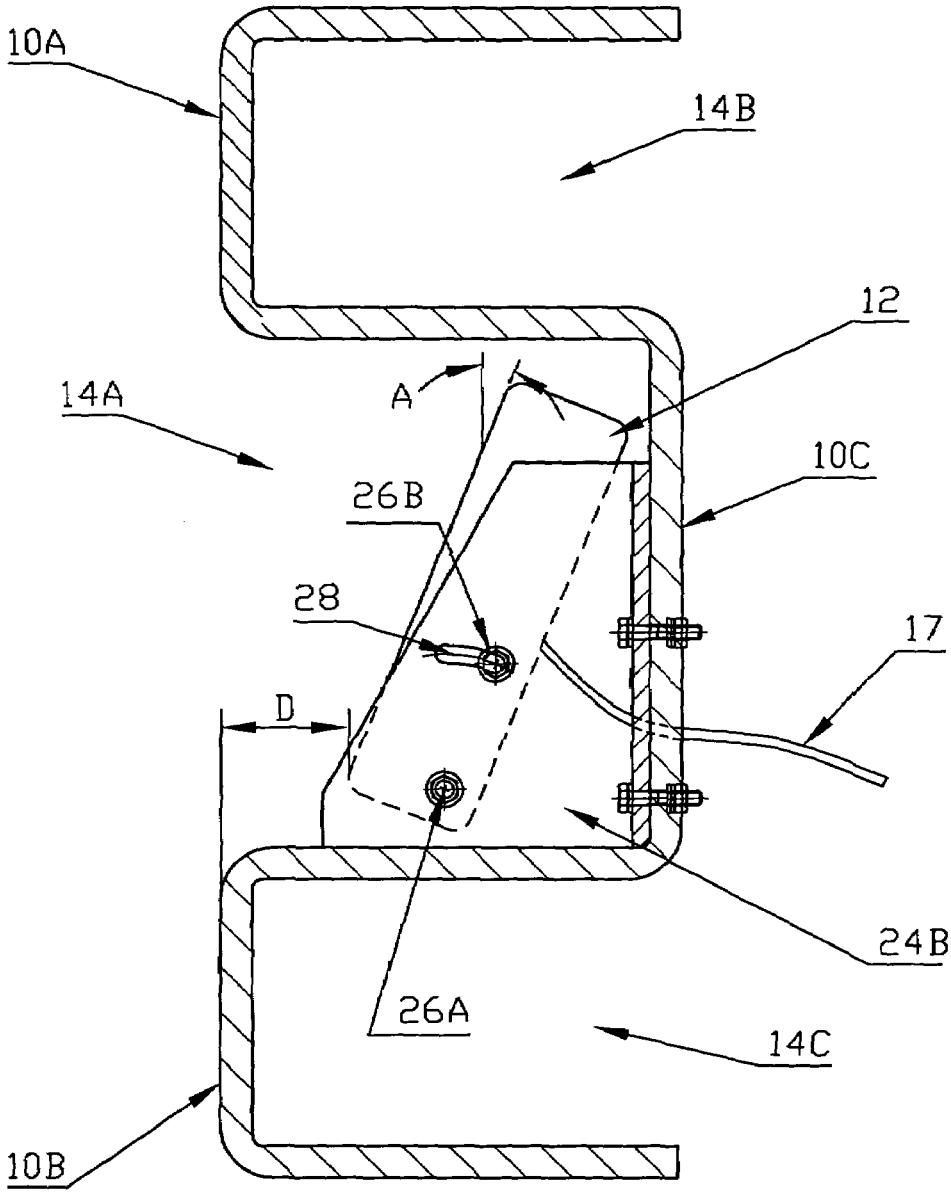
FIG. 1B is a cross-sectional view of the guardrail of FIG. 1 taken on the cutting plane 1B—1B of FIG. 1.
Figure 1C:
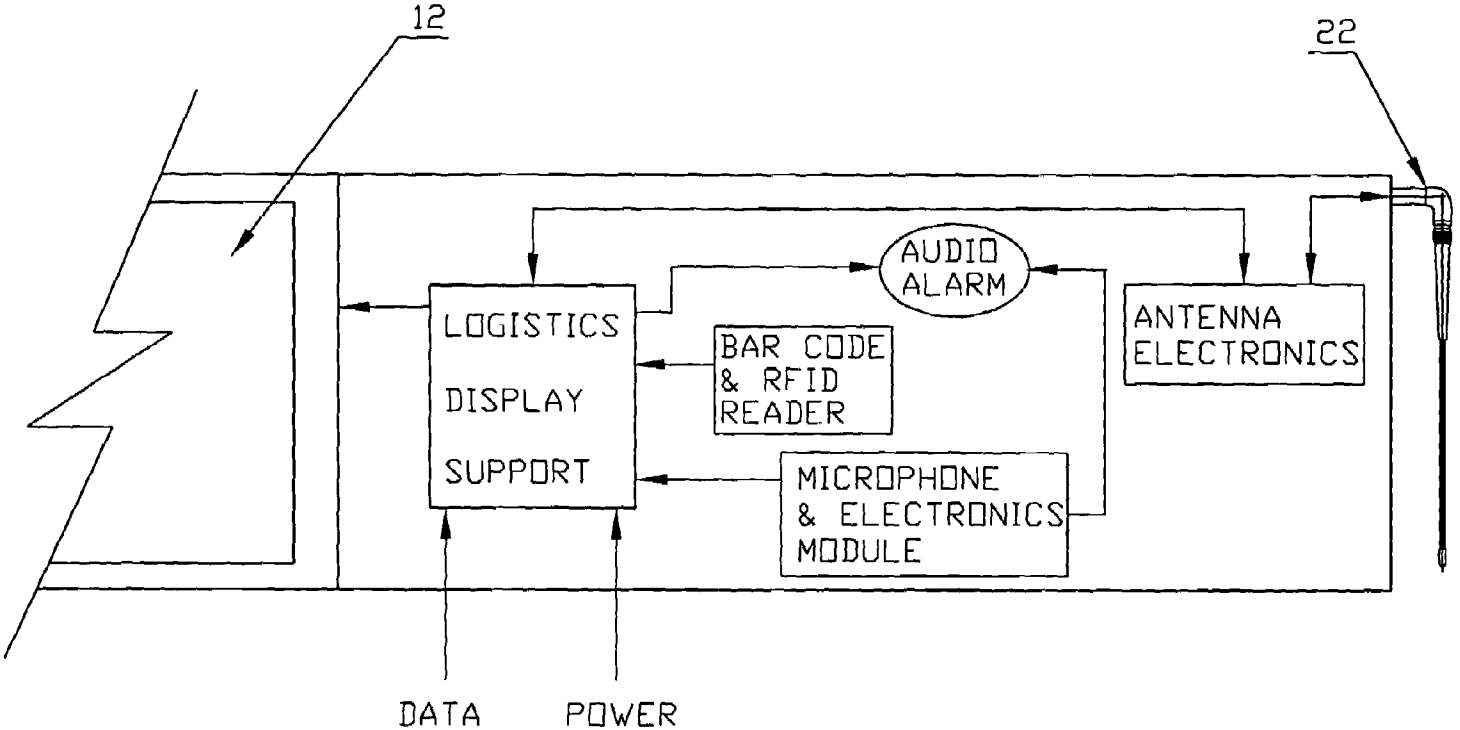
FIG. 1C is a detail of a portion of the guardrail of FIG. 1.
Figure 1D:
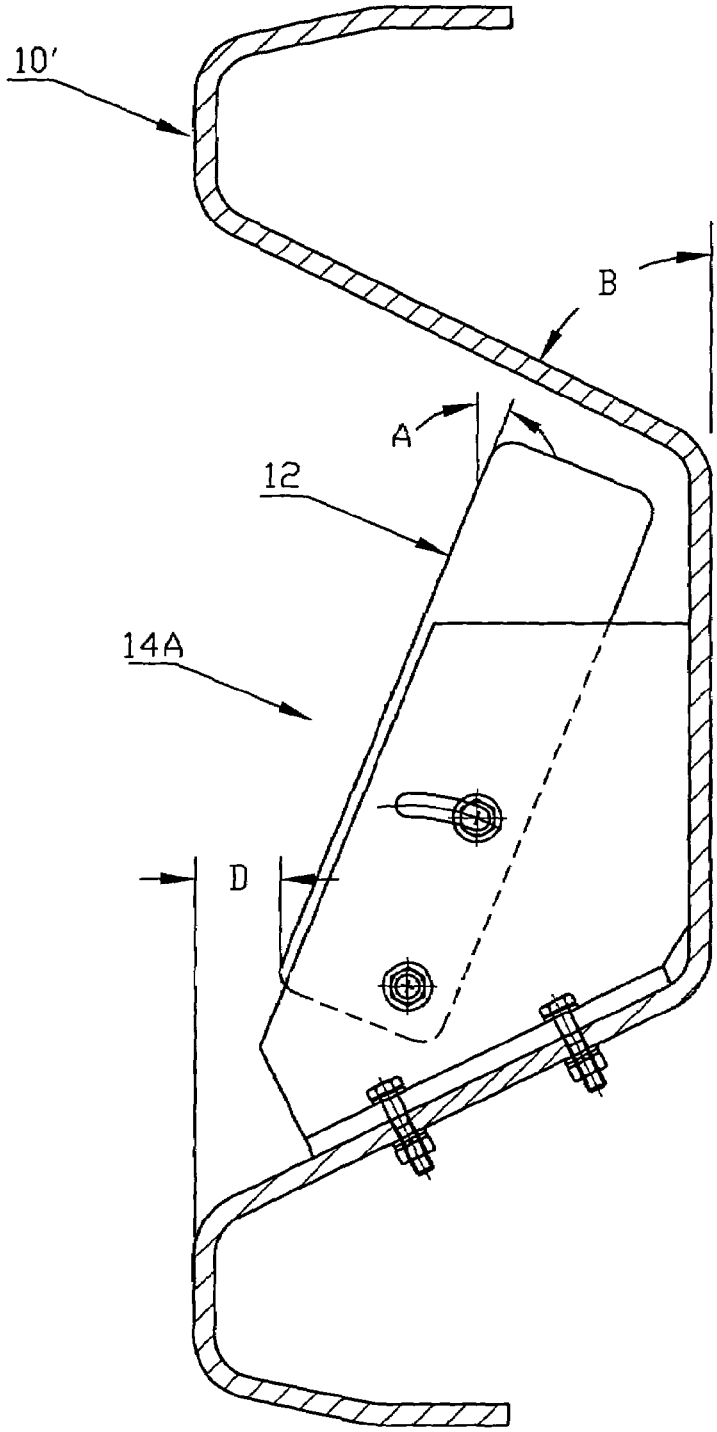
FIG. 1D is a cross-sectional view as in FIG. 1B of an alternative embodiment of a guardrail of the invention.

In the alternative rail 10' of FIG. 1D, recess 14A has been opened more, by decreasing angle B from the 90-degrees of FIG. 1B to 60-degrees. This facilitates the tilting of the display and thereby improves the ability of a forklift operator elevated on the seat of a forklift to see into recess 14A to observe a message on a display 12 in recess 14A.

As indicated in FIG. 1, associated with display 12 in recess 14A is an electronics storage area behind a panel 16. Besides containing electronics for the display 12, this area also has electronic components for bar code reader, RFID reader, and voice-recognition modules, as indicated by the mounting in panel 16 of bar code scanner window 18 and microphone 20. Antenna 22, which is provided for receiving or transmitting wireless communications of data, also is connected into the electronics storage area. Other antenna modes include internal as well as external antennas 22, using wireless technology that would incorporate repeaters installed near the display.

In FIG. 1C, panel 16 (FIG. 1) has been omitted to expose components in the electronic storage area in block diagram. The Logistics Display Support (LDS) is the interface for the display 12. A data line from a computer and a power line feed into the bottom of the LDS (shown combined as line 17 in FIG. 1B). Optionally, data may come to and from the LDS through the line from the ANTENNA ELECTRONICS, which, in turn, transmits and receives the data to and from antenna 22.

The BAR CODE READER and/or RFID reader is connected to the LDS to receive power and for transferring scan data back to the computer. An AUDIO ALARM is driven from the LDS, for instance to emit distinguishable tones for successful scan and unsuccessful scan. Scans are sent to a computer through the ANTENNA ELECTRONICS and antenna 22 or through the data line at the bottom of the LDS. The MICROPHONE AND ELECTRONICS MODULE receives vocal information, which is transmitted to a computer through the LDS and either of the two above-described data routes.

The AUDIO ALARM may also be activated, for instance by a command issued from a computer through the antenna 22 and ANTENNA ELECTRONICS, to draw attention to the display 12, when, for instance, a new message is displayed or an emergency message is being presented on the display.

As shown in FIGS. 1,1B,2,3, display 12 is held in recess 14A by end brackets 24A,B bolted to rail 10. As shown in FIG. 1B, the display can pivot for adjustment of its angle A relative to the guardrail. To provide this adjustability, each end bracket has bolt 26A extending through the bracket and into the display to form a pivot axis, and a bolt 26B extending from the display and running in a slot 28. Slot 28 in the bracket is cut as an arc centered on the axis of bolt 26A. When the desired angle is achieved, the bolts 26A,B are tightened at each bracket, to lock the position of the display relative to the guardrail. Angle A is adjustable over, for example, the range 2 to 22-degrees from vertical, in order to direct the front of the display at the best visual orientation towards the face of a forklift operator elevated above the level of the display.

As shown particularly in FIG. 1B, the display 12 is inset into, i.e. recessed in, the guardrail. The recessing protects the display from impact if a forklift or other mobile equipment hits the guardrail. The recessing is achieved in this example by the structural ribs formed by the convex sections 10A,B of the guardrail that protrude beyond the face of the display. Thus, as shown in FIG. 1B, display 12, throughout the 0 to 30-degree, preferably 2 to 22-degree, range of angle A, is always inset a distance D, which varies over the 2 to 22-degree range of angle A, but is never less than a minimum protective distance, for example ½-inch, behind the faces of the structural ribs.

With reference to FIGS. 1,1A,2,3, welded to the ends of rail 10 are guardrail mounting brackets in the form of mounting plates 30, which have plate bolt holes 32A,B (FIG. 1A) to permit mounting, as shown in FIG. 2, to posts 34 using bolts 36 in post bolt holes 38. Washers and nuts are provided for bolts 36. Alternatively, bolts 36 are long enough to traverse a post 34 and two plates 30, for instance to connect guardrails on opposite sides of a post to the post. In this case, bolts 36 are designed for 5-inch square cross section posts, and shims are used to take up the extra space in the case of 4-inch square posts. The post bolt holes are distributed on the posts to permit mounting of rails at two levels, only the upper level being used in FIG. 2, and on each of the four faces of the post, in order to permit mounting of rails meeting at the post at 90-degrees to one another. The posts in turn are secured to the floor using bolts 40. In cases where the guardrails of the invention are intended as modular units to be incorporated into installations using guardrails of other manufacturers, plates 30 are modified appropriately to fit with those installations. A universal plate 30 having five (5) pre-drilled holes 32B and two (2) slotted holes 32A, some of which are not used in a given installation, can be provided, so that one plate 30 can fit the guardrails of a number of manufacturers.

Figure 4:
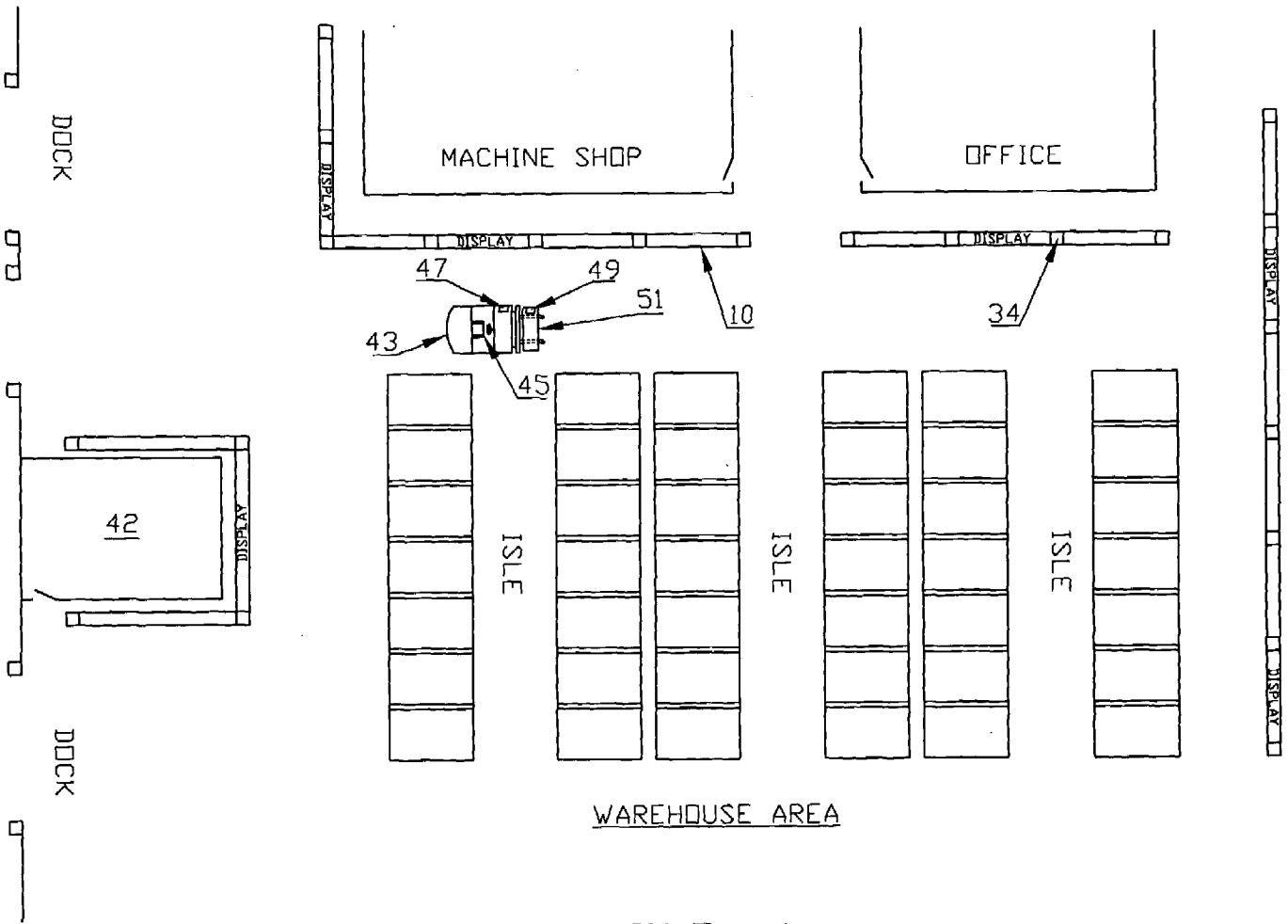
FIGS. 4 and 5 are plan views, respectively, of a warehouse and a retail store parking area, both equipped with guardrails of the invention.

FIG. 4 illustrates use of the invention in a warehouse setting. Guardrails composed of rails 10 and posts 34 are placed in suitable locations for guarding an OFFICE, MACHINE SHOP, a shipping/receiving center 42 by the DOCKS, and otherwise delimiting the warehouse space. The rails equipped as in FIGS. 1–3 are indicated by the label DISPLAY. Forklifts, e.g. forklift 43, circulate in and around the ISLES, along the OFFICE and MACHINE SHOP, and to and from the DOCKS. Operators, e.g. operator 45, of the forklifts can receive instructions on the displays on the basis of scanning through windows 18, or RF scanning of, for example, barcodes or RFID chips, e.g. barcode, or RFID chip, 47, on their forklifts, barcodes or RFID chips, e.g. barcode, or RFID chip, 49, on loads, e.g. load 51, being carried by their forklifts, or identification of the voices of the operators, e.g. operator 45, received in microphones 20. As well, the operators and other occupants of the warehouse can receive any number of other messages, examples of which are provided above in the section DISCLOSURE OF THE INVENTION.

Figure 5:
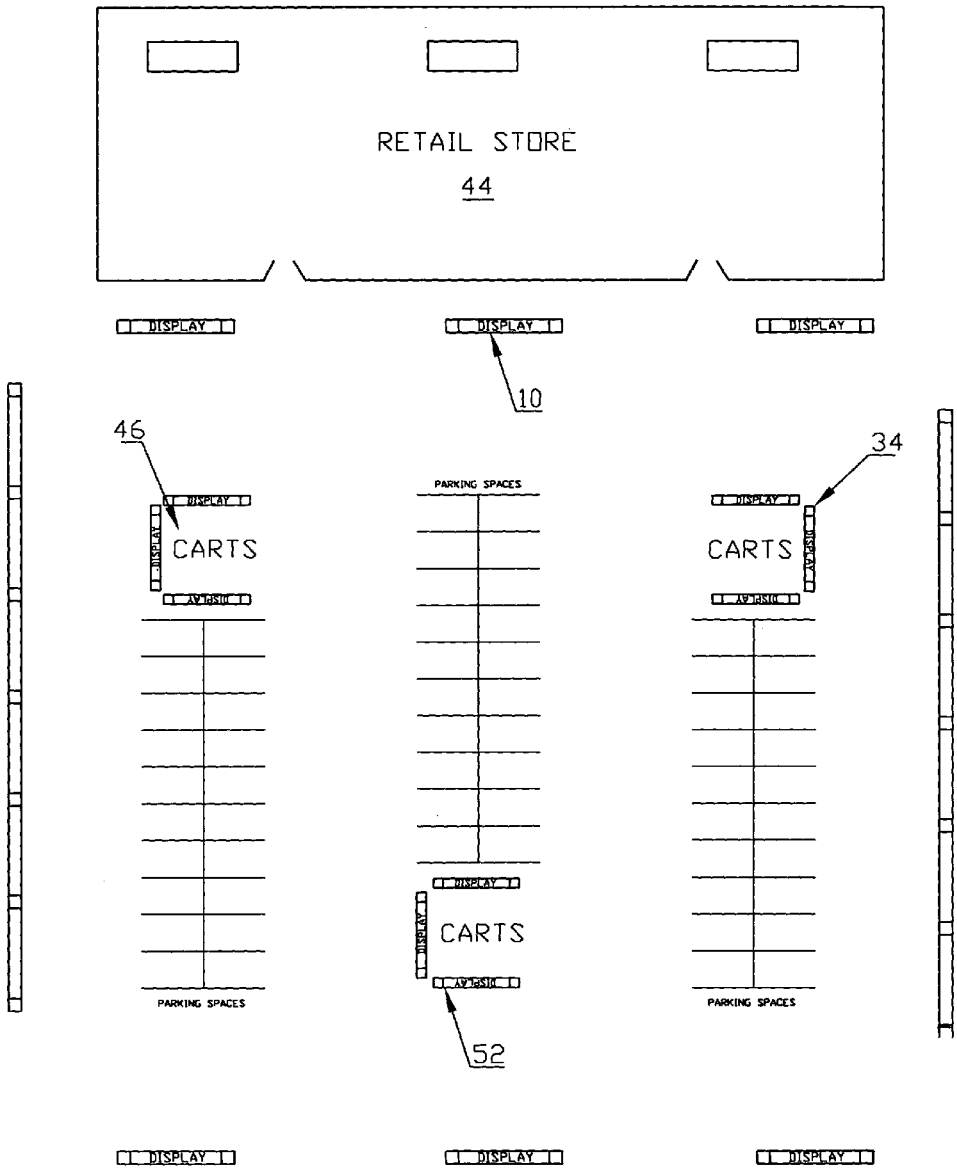

FIG. 5 illustrates use of the invention in a parking area of a RETAIL STORE. Guardrails composed of rails 10 and posts 34 are placed in suitable locations for guarding the store 44, shopping cart return locations 46, and otherwise delimiting the parking area. Those rails equipped as in FIGS. 1–3 are indicated by the label DISPLAY. Vehicle and pedestrian traffic circulates in, enters, and exits the parking area. While some messages for a retail store may be the same as messages for a warehouse (for example employee messages and emergency messages), other messages here will be unique to the retail store environment, and may include, for example: Return shopping carts here; To find goods, request in microphone (the voiced name of the goods is then transcribed to the spelled name, the spelled name matched to goods location, and the display gives the location of the goods in the store); Check our low prices on back-to-school clothing; etc. If messages exceed the letter capacity of the display, the messages may be repetitively scrolled across the display.

For the application of FIG. 5, the voice recognition capability of the MICROPHONE AND ELECTRONICS MODULE of the displays 12 may be used to recognize words such as HELP, EMERGENCY, and ACCIDENT, so that store patrons may activate a computer response to alert security and dispatch assistance. Speaking these words also causes the AUDIO ALARM to sound, as indicated by the connection of the MICROPHONE AND ELECTRONICS MODULE to the AUDIO ALARM in FIG. 1C.

Figure 6:
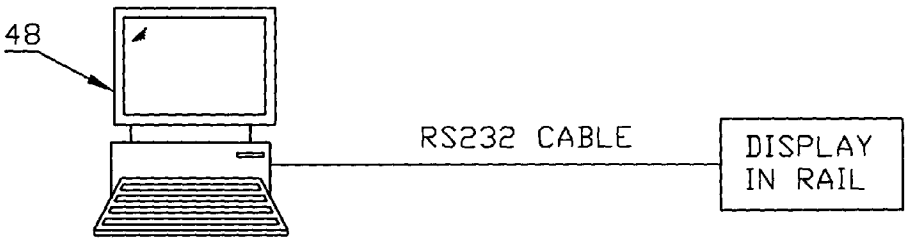
FIGS. 6–8 are block diagrams showing different methods of communicating with the invention.
Figure 7:
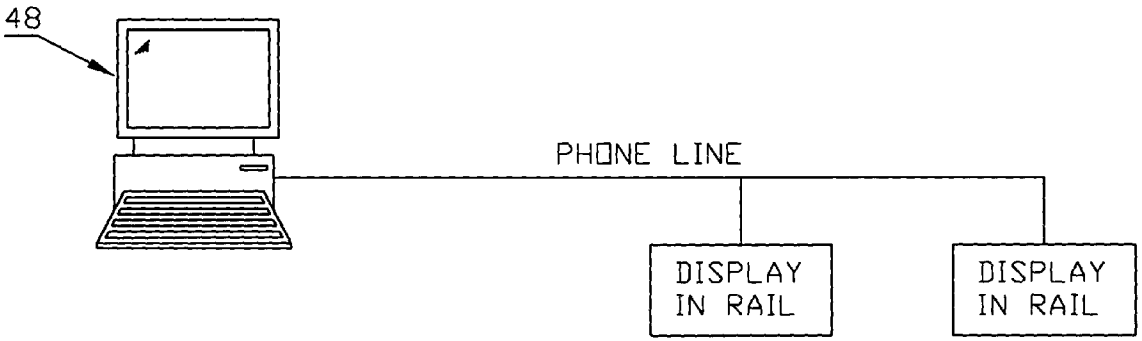
Figure 8:
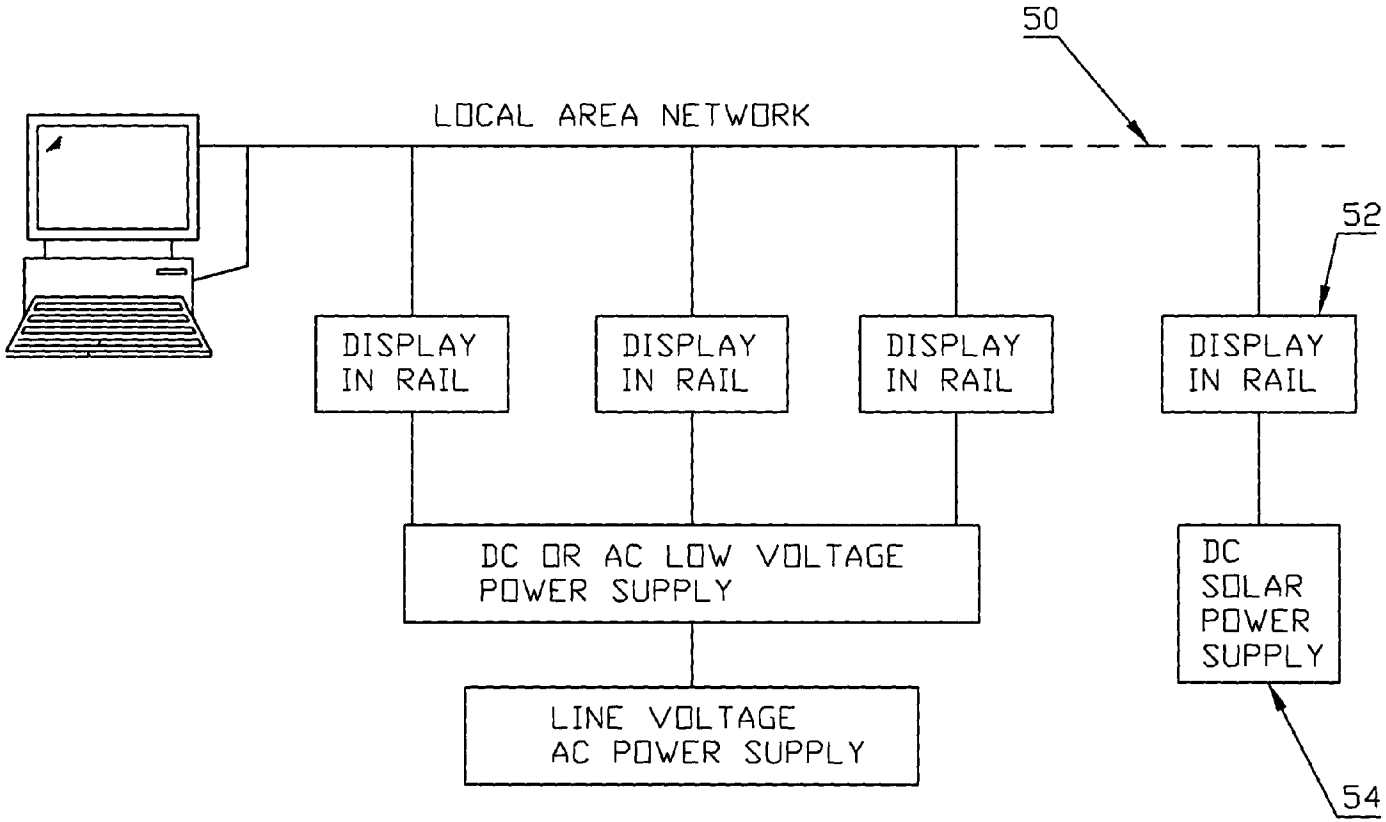

FIGS. 6–8 illustrate different options for communicating messages from computers to guardrails of the invention. The blocks labeled DISPLAY IN RAIL represent guardrails as shown in FIGS. 1–3 founded on an electronic display 12 in a rail 10. FIG. 6 shows direct connection to a display using an RS232 cable from a serial port on a Personal Computer (PC) 48. FIG. 7 shows phone line connection from a dialup modem on the PC to dialup modems at a plurality of displays; this includes the option of a wireless digital modem. FIG. 8 has a Local Area Network (LAN) connection from the PC to one or more displays using the Transmission Control Protocol/Internet Protocol (TCP/IP). The connection media used by the LAN can be any media that supports the TCP/IP protocol (cable, fiber optic, wireless, etc.).

In FIG. 8, the dashed portion 50 of the LAN represents a wireless connection, for instance to a guardrail 52 at a shopping cart return location. Additionally, while the other displays in FIG. 8 are powered by DC power converted from AC power indicated by the labeled blocks, guardrail 52 has a DC solar power supply 54. Therefore, there is no need to run either data transmission or power supply wires to a guardrail 52 in the parking lot of a retail store.

Figure 9B:
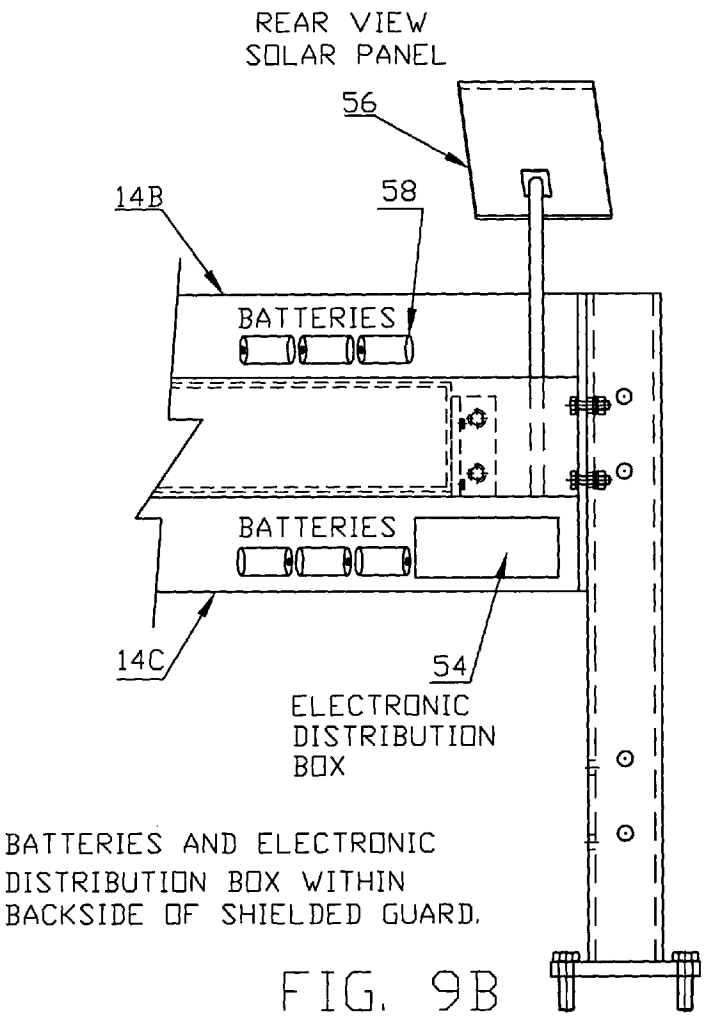
FIG. 9B is a rear view of FIG. 9A.
Figure 9A:
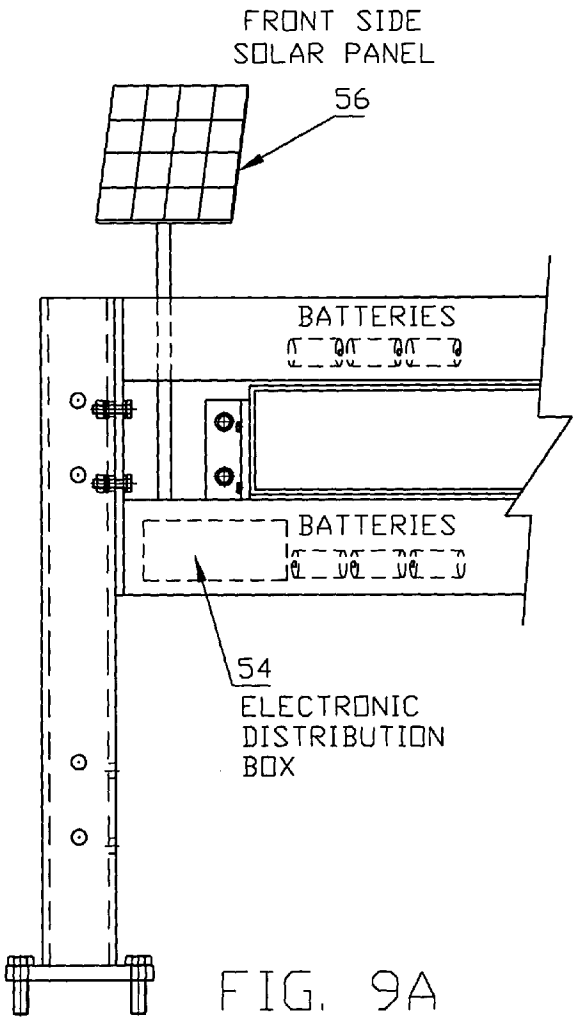
FIG. 9A is a view as in FIG. 2, with parts broken away, schematically showing a modified form of the invention.

FIGS. 9A and 9B show how portions of the supply 54 of FIG. 8 can be merged with the guardrail of FIGS. 1–3. A solar panel 56 for supply 54 is attached to the guardrail while batteries 58 for the supply 54 are arranged in recesses 14B,C on the rear side of the guardrail. Remaining parts of supply 54 can be housed in the electronics storage area behind panel 16.

In an example of the invention, the display is a scrolling message sign, part no. ED100-2411-N1-ETH-SP, by Electronic Displays, Inc., Addison, Ill., and the sign is operated by Windows-based Displayguard™ software supplied by Herwin, Inc., Box 151, Rillton, Pa. 15678. The display is driven by translating ASCII characters, issued from a computer by the software, into a 256 byte receive buffer. These characters are then converted to a message that is shifted out to the display by means of multiplexing. There are 7 rows that control the display board, which are turned on at different times. A serial data signal contains the message that is shifted to the display columns drivers. When the row is turned on, a bit or bits from the display driver causes the LED or LEDs to illuminate. This multiplexing is continued until a new valid message is received into the receive buffer. The characters seen on the display are 4-inches high. Messages on the display of FIG. 2 can be read by a forklift truck operator at distances about in the range from 2 to 200 feet from the display when using a preferred angle A (FIG. 1B) of 15-degrees.

It is to be understood that the above are merely preferred modes of carrying-out the invention and that various changes and alterations can be made without departing from the spirit and broader aspects of the invention as defined by the claims set forth below and by the range of equivalency allowed by law. For example, radio frequency identification (RFID) technology may be used in place of, or to supplement, the above-described applications of bar code.

What is claimed is:

1. A guardrail comprising a rail having a concave section and an electronic display mounted on the rail in the concave section, inset a protective distance into the rail, information on the display comprising computer controllable messages including the written equivalents of a word or words of a spoken language the rail being formed with a cross section curving in the sequence convex, said concave section, convex;

the display being mounted in the rail for angular adjustment relative to the rail, the angular adjustment being about in the range from 2 to 22 degrees.

2. A guardrail as claimed in claim 1, further comprising a bar code scanner and/or a radio frequency identification device scanner for transmitting information to a computer connected with said display.

3. A guardrail as claimed in claim 1, further comprising a voice-recognition module for transmitting information to a computer connected with said display.

4. A guardrail as claimed in claim 1, further comprising a DC solar power supply for the display.

5. A guardrail as claimed in claim 1, wherein (a) said rail is formed with upper and lower laterally elongated convex sections each having a front, and said concave section is between said convex sections, and (b) said electronic display includes a face recessed into the rail said protective distance from said front of the convex sections, said face electronically displaying said messages.

6. The guardrail of claim 1 further comprising a mounting bracket at an end of the rail for mounting the rail onto a post.

7. The guardrail of claim 1 further comprising mounting brackets at opposed ends of the rail, said mounting brackets fastening the rail to posts.

8. The guardrail of claim 1 wherein the electronic display includes LEDs (light emitting diodes).

9. The guardrail of claim 1 wherein the electronic display comprises a scrolling message sign.

10. The guardrail of claim 1 wherein said message is commanded by a computer connected with said display via wire or wirelessly.

* * * * *